US010301697B2

(12) United States Patent
Toyoda et al.

(10) Patent No.: US 10,301,697 B2
(45) Date of Patent: May 28, 2019

(54) HIGH STRENGTH HOT ROLLED STEEL SHEET AND MANUFACTURING METHOD THEREOF

(71) Applicant: NIPPON STEEL & SUMITOMO METAL CORPORATION, Tokyo (JP)

(72) Inventors: Takeshi Toyoda, Tokyo (JP); Daiki Kamada, Tokyo (JP); Yuuki Kanzawa, Tokyo (JP); Mayuko Kikuzuki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/775,149

(22) PCT Filed: Nov. 19, 2015

(86) PCT No.: PCT/JP2015/082591

§ 371 (c)(1),
(2) Date: May 10, 2018

(87) PCT Pub. No.: WO2017/085841

PCT Pub. Date: May 26, 2017

(65) Prior Publication Data

US 2018/0327878 A1 Nov. 15, 2018

(51) Int. Cl.

| | |
|---|---|
| ***C22C 38/02*** | (2006.01) |
| ***C21D 8/02*** | (2006.01) |
| ***C21D 9/46*** | (2006.01) |
| ***C22C 38/00*** | (2006.01) |
| ***C22C 38/14*** | (2006.01) |
| ***C22C 38/38*** | (2006.01) |
| *C22C 38/04* | (2006.01) |
| *C22C 38/06* | (2006.01) |

(52) U.S. Cl.

CPC ..... *C21D 8/0226* (2013.01); *C21D 8/0263* (2013.01); *C21D 9/46* (2013.01); *C22C 38/00* (2013.01); *C22C 38/02* (2013.01); *C22C 38/14* (2013.01); *C22C 38/38* (2013.01); *C22C 38/001* (2013.01); *C22C 38/04* (2013.01); *C22C 38/06* (2013.01)

(58) Field of Classification Search

CPC ..... C22C 38/02; C21D 8/0226
USPC ..... 148/320
See application file for complete search history.

(56) References Cited

U.S. PATENT DOCUMENTS

| | | | |
|---|---|---|---|
| 2009/0252641 | A1 | 10/2009 | Hoshi et al. |
| 2011/0240176 | A1 | 10/2011 | Kaneko et al. |
| 2015/0329950 | A1 | 11/2015 | Azuma et al. |

FOREIGN PATENT DOCUMENTS

| | | | |
|---|---|---|---|
| JP | 2007-302918 | A | 11/2007 |
| JP | 2008-255484 | A | 10/2008 |
| JP | 2009-19258 | A | 1/2009 |
| JP | 2010-275627 | A | 12/2010 |
| JP | 2011-184788 | A | 9/2011 |
| JP | 2014-205890 | A | 10/2014 |
| JP | 2015-86415 | A | 5/2015 |
| WO | WO 2006/107066 | A1 | 10/2006 |
| WO | WO 2010/061972 | A1 | 6/2010 |
| WO | WO 2014/132968 | A1 | 9/2014 |

OTHER PUBLICATIONS

International Search Report for PCT/JP2015/082591 dated Feb. 16, 2016.
Notice of Allowance for TW 104138260 dated Oct. 12, 2016.
Written Opinion of the International Searching Authority for PCT/JP2015/082591 (PCT/ISA/237) dated Feb. 16, 2016.

*Primary Examiner* — Brian D Walck
(74) *Attorney, Agent, or Firm* — Birch, Stewart, Kolasch & Birch, LLP

(57) ABSTRACT

This high strength hot rolled steel sheet has a predetermined chemical composition, in which the structure of the high strength hot rolled steel sheet contains martensite in an area ratio of 20% or more and 60% or less and ferrite in an area ratio of 40% or more, and the total area ratio of the martensite and the ferrite is 90% or more, the average grain size of the martensite is 5.0 μm or more and 50 μm or less, the ratio of the hardness of the martensite to the hardness of the ferrite is 0.6 or more and 1.6 or less, and the tensile strength of the high strength hot rolled steel sheet is 980 MPa or more.

2 Claims, No Drawings

HIGH STRENGTH HOT ROLLED STEEL SHEET AND MANUFACTURING METHOD THEREOF

TECHNICAL FIELD OF THE INVENTION

The present invention relates to a high strength hot rolled steel sheet and a manufacturing method thereof, and particularly to a high strength hot rolled steel sheet which is excellent in elongation and hole expansibility and has a tensile strength of 980 MPa or more, and a manufacturing method thereof.

RELATED ART

In recent years, for the purpose of improving the fuel efficiency and collision safety of a vehicle, efforts to reduce the weight of the vehicle body by applying a high strength steel sheet have been actively carried out. However, high-strengthening of the steel sheet generally causes deterioration of material properties such as formability (workability). Therefore, in the development of a high strength steel sheet, an important object is to achieve high-strengthening without deterioration of material properties. In particular, in a high strength steel sheet applied to a member of a vehicle, securing press formability is important. Here, it is known that a dual phase steel sheet (hereinafter, referred to as DP steel) having a composite structure of soft ferrite and hard martensite has excellent uniform elongation. On the other hand, in the DP steel, voids are generated at the interface between the ferrite and the martensite which are significantly different from each other in hardness, and there is a problem of deterioration of hole expansibility. Therefore, the DP steel is unsuitable for applications requiring high hole expansibility, such as suspension components.

Regarding this, Patent document 1 proposes a hot rolled steel sheet having an excellent balance between elongation and hole expansibility, in which the structure fraction of martensite is controlled to be 3% or more and less than 10%, which is low in terms of DP steel, Ti and Nb are added as substitutes therefor, an air cooling band is provided during run out table (ROT) cooling in hot rolling to cause carbides of Ti and/or Nb to precipitate in ferrite, and thus the strength is improved by precipitation strengthening.

However, in the invention described in Patent Document 1, the hole expansibility is improved by reducing the fraction of the martensite. Therefore, in order to obtain a tensile strength of 980 MPa or more as the strength, it is necessary to further increase the hardness of the ferrite. However, when the hardness of the ferrite is increased, there is a problem of a decrease in elongation.

Patent Document 2 proposes a high strength hot rolled steel sheet having a tensile strength of 980 MPa or more, which is improved in elongation and hole expansibility by setting the area ratio of bainitic ferrite to 90% or more. In addition, Patent Document 3 proposes a hot rolled steel sheet which is improved in hole expansibility by setting the area ratio of bainite to 90% or more and thereafter controlling the amount and average grain size of cementite dispersed in the structure.

However, in the inventions described in Patent Documents 2 and 3, the bainitic ferrite has a structure close to a single phase primarily containing the bainitic ferrite, and sufficient elongation is not obtained.

PRIOR ART DOCUMENT

Patent Document

[Patent Document 1] Japanese Unexamined Patent Application, First Publication No. 2011-184788

[Patent Document 2] Japanese Unexamined Patent Application, First Publication No. 2008-255484

[Patent Document 3] Japanese Unexamined Patent Application, First Publication No. 2014-205890

DISCLOSURE OF THE INVENTION

Problems to be Solved by the Invention

In recent years, there is an increasing demand for a further reduction in the weight of a vehicle, and for complexity of component shapes in the background, a high strength hot rolled steel sheet having higher hole expansibility and elongation is required.

The present invention has been made taking the foregoing problems into consideration, and an object of the present invention is to provide a high strength hot rolled steel sheet excellent in elongation and hole expansibility.

Means for Solving the Problem

In the related art, for the improvement in the material of DP steel, various efforts have been made to suppress the generation of voids at the interface between martensite and ferrite. The present inventors focused attention on the fact that cracks in martensite initiated during working are the cause of deterioration of elongation and hole expansibility and intensively studied. As a result, by reverse thinking to softening of martensite, which is originally hard, it was found that the DP steel properties can be improved. Specifically, it was found that in a cooling process in hot rolling, the degree of working of austenite, which controls the ferritic transformation rate, and run out table (ROT) air cooling, which controls the ferritic transformation, are controlled to control the fraction of ferrite, C enrichment in the austenite is thus suppressed, and as a result, the ductility of the martensite is significantly improved. In addition, it was confirmed that by improving the ductility of the martensite, the generation of voids during working can be suppressed.

The present invention has been made based on the above findings, and the gist of the present invention is as follows.

(1) According to an aspect of the present invention, a high strength hot rolled steel sheet includes, by mass %; C: 0.02% or more and 0.30% or less; Si: 0.20% or more and 2.0% or less; Mn: 0.5% or more and 3.0% or less; P: 0.10% or less; S: 0.010% or less; Al: 0.10% or more and 1.0% or less; N: 0.010% or less; Ti: 0.06% or more and 0.20% or less; Nb: 0% or more and 0.10% or less; Ca: 0% or more and 0.0060% or less; Mo: 0% or more and 0.50% or less; Cr: 0% or more and 1.0% or less; and a remainder of Fe and impurities, in which a structure of the high strength hot rolled steel sheet contains a martensite in an area ratio of 20% or more and 60% or less and a ferrite in an area ratio of 40% or more, and a total area ratio of the martensite and the ferrite is 90% or more, an average grain size of the martensite is 5.0 μm or more and 50 μm or less, a ratio of a hardness of the martensite to a hardness of the ferrite is 0.6 or more and 1.6 or less, and a tensile strength of the high strength hot rolled steel sheet is 980 MPa or more.

(2) In the high strength hot rolled steel sheet according to (1), the hot rolled steel sheet may include one or more of, by mass %: Nb: 0.01% or more and 0.10% or less; Ca: 0.0005% or more and 0.0060% or less; Mo: 0.02% or more and 0.50% or less; and Cr: 0.02% or more and 1.0% or less.

Effects of the Invention

According to the aspect of the present invention, the high strength hot rolled steel sheet which is suitable for press components requiring high workability and is excellent in elongation and hole expansibility can be provided. With the high strength steel sheet, a reduction in the weight of the vehicle body of a vehicle or the like, integral forming of components, and a reduction in the number of working processes are possible, and the improvement of fuel efficiency and a reduction in manufacturing costs can be achieved. Therefore, the present invention has high industrial value.

EMBODIMENTS OF THE INVENTION

A high strength hot rolled steel sheet according to an embodiment of the present invention (sometimes referred to as a hot rolled steel sheet according to this embodiment) will be described. In the hot rolled steel sheet according to this embodiment, C enrichment in austenite is controlled by controlling the transformation rate and fraction of ferrite formed during cooling after hot finish rolling, thereby improving the ductility of martensite. Therefore, the hot rolled steel sheet according to this embodiment is excellent in elongation and hole expansibility. Specifically, the hot rolled steel sheet according to this embodiment has a predetermined chemical composition, in which the structure of the high strength hot rolled steel sheet contains martensite in an area ratio of 20% or more and 60% or less and ferrite in an area ratio of 40% or more, the total area ratio of the martensite and the ferrite is 90% or more, the average grain size of the martensite is 5.0 μm or more and 50 μm or less, the ratio of the hardness of the martensite to the hardness of the ferrite is 0.6 or more and 1.6 or less, and the tensile strength of the high strength hot rolled steel sheet is 980 MPa or more.

Hereinafter, the element for each element of the present invention will be described in detail. First, the reason for limiting the chemical composition of the hot rolled steel sheet according to this embodiment will be described. Regarding the amount of a component, % means mass %.

<C: 0.02% or More and 0.30% or Less>

C is an important element for improving the strength of the steel sheet. In order to obtain a desired strength, it is necessary to set the C content to 0.02% or more, and preferably 0.04% or more. However, when the C content exceeds 0.30%, the toughness of the steel sheet deteriorates. Therefore, the C content is set to 0.30% or less, and preferably 0.20% or less.

<Si: 0.20% or More and 2.0% or Less>

Si is an element which has an effect of improving the ductility of the steel sheet by suppressing the formation of carbides during ferritic transformation. In order to obtain this effect, the Si content is set to 0.20% or more, and preferably 0.50% or more. On the other hand, when the Si content exceeds 2.0%, the toughness of the steel sheet deteriorates. Therefore, the Si content is set to 2.0% or less, and preferably 1.5% or less.

<Mn: 0.5% or More and 3.0% or Less>

Mn is an element effective for improving the strength of the steel sheet by the improvement in hardenability and solid solution strengthening. In order to obtain this effect, the Mn content is set to 0.5% or more, and preferably 1.0% or more. On the other hand, when the Mn content exceeds 3.0%, MnS, which is harmful to isotropy of toughness, is formed. Therefore, the Mn content is set to 3.0% or less, and preferably 2.0% or less.

<P: 0.10% or Less>

P is an impurity, and the lower the P content, the better. However, when the P content exceeds 0.10%, the workability and weldability significantly deteriorate, and the fatigue properties also deteriorate. Therefore, the P content is limited to 0.10% or less, and is preferably 0.05% or less.

<S: 0.010% or Less>

S is an impurity, and the lower the S content, the better. However, when the S content exceeds 0.010%, inclusions such as MnS harmful to the isotropy of toughness are significantly formed. Therefore, the S content is limited to 0.010% or less. In a case where particularly severe low-temperature toughness is required, it is preferable to set the S content to 0.006% or less.

<Al: 0.10% or More and 1.0% or Less>

Al is an important element for controlling the ferritic transformation. In order to obtain this effect, the Al content is set to 0.10% or more, and preferably 0.20% or more. However, when the Al content exceeds 1.0%, alumina precipitated in a cluster form is formed and the toughness deteriorates. Therefore, the Al content is set to 1.0% or less, and preferably 0.8% or less.

<N: 0.010% or Less>

N is an impurity. When the N content exceeds 0.010%, coarse Ti nitride is formed at a high temperature, and the toughness of the steel sheet deteriorates. Therefore, the N content is set to 0.010% or less, and preferably 0.006% or less.

<Ti: 0.06% or More and 0.20% or Less>

Ti is an element for precipitation strengthening of ferrite, and is an important element for obtaining a target ferrite fraction by controlling ferritic transformation. In order to obtain excellent elongation and hole expansibility by precipitation strengthening and ferritic transformation control, the Ti content is set to 0.06% or more, and preferably 0.08% or more. On the other hand, when the Ti content exceeds 0.20%, inclusions due to TN are formed, and the hole expansibility of the steel sheet deteriorates. Therefore, the content of Ti is set to 0.20% or less, and preferably 0.16% or less.

The hot rolled steel sheet according to this embodiment basically contains the above-described chemical composition and the remainder of Fe and impurities. However, Nb, Ca, Mo, and Cr may be contained in the following ranges in order to reduce manufacturing variations and further improve strength even though the elements are not essential to satisfy required properties. However, since any of Nb, Ca, Mo and Cr is not essential to satisfy the required properties, the lower limit of the amount thereof is 0%. Here, the impurities mean components incorporated due to raw materials such as ore and scrap and other factors when steel is industrially manufactured. When the amounts of Nb, Ca, Mo, and Cr are less than the lower limits described below, the elements can be regarded as impurities and do not impair the effect of the hot rolled steel sheet according to this embodiment.

<Nb: 0.01% or More and 0.10% or Less>

Nb is an element having an effect of increasing the strength of the steel sheet by refinement of the grain size of the hot rolled steel sheet and precipitation strengthening of NbC. In a case of obtaining this effect, it is preferable to set the Nb content to 0.01% or more. On the other hand, when the Nb content exceeds 0.10%, the effect is saturated. Therefore, even in a case where Nb is contained, the upper limit of the Nb content is set to 0.10%. A more preferable upper limit thereof is 0.06% or less.

<Ca: 0.0005% or More and 0.0060% or Less>

Ca is an element having an effect of dispersing a large number of fine oxides at the time of deoxidizing molten steel and refining the structure of the steel sheet. In addition, Ca is an element that improves the hole expansibility by fixing S in steel as spherical CaS and suppressing the formation of stretched inclusions such as MnS. In a case of obtaining these effects, it is preferable to set the Ca content to 0.0005% or more. On the other hand, even when the Ca content exceeds 0.0060%, the effect is saturated. Therefore, even in a case where Ca is contained, the upper limit of the Ca content is set to 0.0060%. A more preferable upper limit thereof is 0.0040%.

<Mo: 0.02% or More and 0.50% or Less>

Mo is an element effective for precipitation strengthening of ferrite. In a case of obtaining this effect, it is preferable to set the Mo content to 0.02% or more, and more preferably 0.10% or more. On the other hand, when the Mo content is excessive, the crack sensitivity of a slab increases, and it becomes difficult to handle the slab. Therefore, even in a case where Mo is contained, the upper limit of the Mo content is set to 0.50%. A more preferable upper limit thereof is 0.30%.

<Cr: 0.02% or More and 1.0% or Less>

Cr is an element effective for improving the strength of the steel sheet. In a case of obtaining this effect, it is preferable to set the Cr content to 0.02% or more, and more preferably 0.1% or more. On the other hand, when the Cr content is excessive, ductility decreases. Therefore, even in a case where Cr is contained, the upper limit of the Cr content is set to 1.0%. A more preferable upper limit thereof is 0.8%.

Next, the structure of the hot rolled steel sheet according to this embodiment will be described.

The hot rolled steel sheet according to this embodiment has a structure primary having a dual phase of martensite and ferrite. Primarily having a dual phase means that the total area ratio of martensite and ferrite is 90% or more. The remainder may contain a structure such as bainite or pearlite. The residual structure may be 0%. That is, the total area ratio of martensite and ferrite may be 100%.

A steel sheet (composite structure steel sheet) having a composite structure in which a hard structure such as martensite is dispersed in ferrite which is soft and has excellent elongation can realize high strength and high elongation. However, in the composite structure steel sheet, high strain is concentrated in the vicinity of the hard structure and the crack propagation speed increases. Therefore, there is a disadvantage that the hole expansibility decreases. In the related art, there have been many studies regarding control of the fractions of ferrite and martensite and the size of martensite for the purpose of decreasing the crack propagation speed. On the other hand, unlike the related art, in the hot rolled steel sheet according to this embodiment, the local ductility of the martensite is improved by softening the martensite, thereby suppressing deterioration of the hole expansibility due to the martensite as much as possible. Simultaneously, by increasing the fraction of the martensite, a high strength of 980 MPa is obtained.

<Martensite in Area Ratio of 20% or More and 60% or Less and Ferrite in Area Ratio of 40% or More are Contained and Total Area Ratio of Martensite and Ferrite is 90% or More>

In a structure primarily having a dual phase of martensite and ferrite in a total area ratio of 90% or more, when the area ratio (structure fraction) of the ferrite is less than 40%, strain relaxation or workability by ferrite grains cannot be secured, and the balance between elongation and hole expansibility is deteriorated. Therefore, the area ratio of the ferrite is set to 40% or more. On the other hand, when the area ratio of the ferrite exceeds 80%, a desired martensite area ratio cannot be secured.

In addition, when the area ratio of the martensite is less than 20%, strain during hole expansion is concentrated on the martensite grains, and voids are easily formed, resulting in a decrease in hole expansibility. On the other hand, when the area ratio of the martensite exceeds 60%, elongation decreases because the martensite with poor ductility becomes a main phase. Therefore, the area ratio of the martensite is set to 20% or more and 60% or less, and preferably 30% or more and 50% or less.

The above-mentioned structure can be identified by etching a sample cut from the hot rolled steel sheet to appear the structure of the sample and using a photograph of the structure. A method of measuring each structure is not limited as long as the method is a measurement method with excellent accuracy. For example, determination of each phase and measurement of area ratios and average grain sizes can be performed as follows. That is, each phase is determined by performing LePera etching or Nital etching on the steel sheet and observing the structure at a ¼ depth position in a section in a hot rolling direction with an optical microscope or scanning electron microscope (SEM). The area ratio and average grain size of each phase may be measured using an image analyzer or the like.

<Average Grain Size of Martensite is 5.0 μm or More and 50 μm or Less>

The hot rolled steel sheet according to this embodiment needs to satisfy the above-described structure fractions and further satisfy the average grain size of the martensite and the hardness ratio between the martensite and the ferrite (hardness of martensite/hardness of ferrite).

In order to obtain excellent hole expansibility, the average grain size of the martensite needs to be 5.0 μm or more and 50 μm or less. When the average grain size of the martensite is less than 5.0 μm, the hole expansibility deteriorates. On the other hand, when the average grain size of the martensite exceeds 50 μm elongation deteriorates. Therefore, for the compatibility of elongation and hole expansibility, the average grain size of the martensite is set to 5.0 μm or more and 50 μm or less, and preferably 20 μm or less.

Furthermore, in a case of obtaining excellent elongation and hole expansibility, it is preferable that the average grain size of the martensite is in the above-mentioned range and the proportion in number of the martensite having a grain size of 10 to 30 μm is 40% to 55%.

<Ratio of Hardness of Martensite to Hardness of Ferrite is 0.6 or More and 1.6 or Less>

The hardness ratio between the martensite and the ferrite needs to be 0.6 or more and 1.6 or less. In a case where the hardness of the ferrite is high and the hardness ratio is less than 0.6, the ductility of the ferrite deteriorates and the elongation of the steel sheet deteriorates. On the other hand, when the hardness of the martensite is high and the hardness ratio is more than 1.6, the plastic deformability of the martensite decreases, the local ductility thereof decreases, and the hole expansibility of the steel sheet deteriorates. Therefore, for the compatibility of elongation and hole expansibility, the hardness ratio between the martensite and the ferrite is set to 0.6 or more and 1.6 or less. The range of a preferable hardness ratio is 0.8 or more and 1.2 or less, and more preferably 0.8 or more and 1.0 or less.

The hardness ratio can be obtained by measuring the hardness of each of the ferrite and the martensite through Vickers measurement at the ¼ depth position in the section in the hot rolling direction. However, during the Vickers hardness measurement, it is difficult to obtain the hardness of a structure smaller than the size of an indenter. Therefore, in a case where the Vickers test cannot be conducted due to small grain sizes, measurement may be performed using nanoindentation or a microhardness test. In this case, a value converted into the Vickers hardness is used. For this conversion, it is necessary to obtain a converted value with high accuracy by using a standard sample having similar hardness, or the like. In addition, in order to improve the measurement accuracy, it is necessary to measure the hardnesses of 100 or more points in each structure of the martensite and the ferrite and calculate the average thereof.

<Tensile Strength is 980 MPa or More>

Assuming that the hot rolled steel sheet according to this embodiment is applied to the improvement in the collision safety of a vehicle or the like and a reduction in the weight of a vehicle body, the tensile strength of the hot rolled steel sheet is set to 980 MPa or more. The upper limit of the tensile strength is preferably 1450 MPa or less in order to utilize excellent ductility of the ferrite.

The hot rolled steel sheet according to this embodiment can obtain its efficiency by having the chemical composition and the structure described above regardless of the manufacturing method. However, according to the manufacturing method described below, the hot rolled steel sheet according to this embodiment can be stably obtained, which is preferable.

Specifically, a manufacturing method of the hot rolled steel sheet according to this embodiment preferably includes the following processes (a) to (f).

(a) A heating process of heating a slab having the above-described chemical composition at a temperature of 1200° C. or higher and lower than 1350° C.

(b) A rolling process of rolling the slab after the heating process using a rolling mill having a plurality of stands, in which rolling in the final stand and in the preceding stand is performed in a temperature range of Ar3 or higher and 960° C. or lower and rolling is performed by setting the ratio of the total of the rolling reductions of the final stand and the preceding stand to the sum of all of the rolling reductions of the stands of the continuous finish rolling stands to 0.12 or more and 0.30 or less and setting the ratio between the rolling reductions of the final stand and the preceding stage (preceding stand) to 0.5 or more and less than 1.0, thereby obtaining a steel sheet.

(c) A primary cooling process of starting cooling within 1.5 seconds after the end of the rolling and performing cooling to 600° C. or higher and 750° C. or lower at a cooling rate of 40° C./s or more.

(d) An intermediate air cooling process of performing air cooling at a cooling rate of 10° C./s or less for two seconds or longer and ten seconds or shorter after the primary cooling process.

(e) A secondary cooling process of performing cooling to 300° C. or lower at a cooling rate of 60° C./s or more after the intermediate air cooling process.

(f) A winding process of performing winding after the secondary cooling process.

Hereinafter, each of the processes will be described.

In this embodiment, the cooling rate is an average cooling rate from the start of cooling to the stop of cooling. In addition, the Ar3 point (° C.) is a temperature at which austenitic transformation is started during cooling and can be appropriately obtained. In a simple manner, the Ar3 point can be obtained by the following expression based on the amount of each element.

$$Ar3=901-325\times C+33\times Si-92\times Mn+287\times P+40\times Al$$

<Heating Process>

The slab is heated before hot rolling (hot rolling). When the slab having the same chemical composition as that of the hot rolled steel sheet according to this embodiment obtained by continuous casting or the like is heated, at a heating temperature of lower than 1200° C., homogenizing of the slab and dissolution of Ti carbides contained in the slab are insufficient. In this case, the strength or workability of the resultant steel sheet decreases. On the other hand, when the heating temperature is 1350° C. or higher, the initial austenite grain size increases, so that the finally obtained steel sheet tends to have a duplex grain structure. This also leads to an increase in manufacturing costs and a decrease in productivity. Therefore, the heating temperature is preferably 1200° C. or higher and lower than 1350° C.

<Rolling Process>

In the rolling process, in tandem rolling in which the steel sheet is continuously rolled using the rolling mill having the plurality of stands, it is important to control the rolling temperatures and rolling reductions in the final stand and the preceding stage (the stand preceding the final stand). By controlling the rolling temperatures and rolling reductions during rolling in the final stand and the preceding stage, the dislocation density of austenite can be optimized. The dislocation density of the austenite significantly affects the ferritic transformation rate and the C enrichment rate in the austenite in the subsequent processes.

Specifically, it is necessary to perform rolling in the final stand and in the preceding stage in a temperature range of the austenite single phase. Therefore, the rolling in the final stand and the preceding stage is performed at the Ar3 points or higher. In addition, in order to suppress the recovery of dislocations accumulated by the rolling, the rolling is performed in the final stand and the preceding stage at 960° C. or lower. When the rolling is performed at a temperature of higher than 960° C., the recovery and recrystallization of the austenite are promoted, and dislocations cannot be accumulated.

The ratio of the total of the rolling reductions of the final stand and the preceding-stage stand to the sum of all of the rolling reductions of the stands of the continuous finish rolling stands (latter stage rolling reduction ratio) is set to 0.12 or more and 0.30 or less. When the rolling reduction ratio is less than 0.12, recrystallization in the former stage of the finish rolling is promoted, and strain cannot be accumulated in the latter stage. In this case, ferritic transformation is delayed in the cooling process of the subsequent process. On the other hand, when the rolling reduction ratio is more than 0.30, the rolling reduction of the former stage is insufficient, resulting in structure coarsening. The rolling reduction ratio is preferably 0.20 or more and 0.25 or less. Here, the total of the rolling reductions, or the sum of the rolling reductions is the sum of the rolling reductions, and for example, in a case where rolling with a rolling reduction of 20% is performed twice, becomes 20+20=40%.

In addition, the ratio of the rolling reduction of the final stand to the rolling reduction of the preceding stage (rolling reduction of final stand/rolling reduction of preceding stage) is set to 0.5 or more and less than 1.0, thereby obtaining a steel sheet. When the ratio between the rolling reductions of the final stand and the preceding stage (rolling reduction of final stand/rolling reduction of preceding stage) is less than 0.5, the strain is insufficient and the ferritic transformation is delayed in the cooling process of the subsequent process. In this case, ferrite and martensite in target area ratios cannot be obtained. Furthermore, coarse martensite is formed, and the average grain size of the martensite exceeds 50 μm. On the other hand, when the ratio between the rolling reductions of the final stand and the preceding stage is 1.0 or more, the ferritic transformation proceeds too fast, and ferrite and martensite in target area ratios cannot be obtained. Furthermore, the diffusion rate of C increases, C enrichment in austenite proceeds, and martensite, which has an average grain size of less than 5.0 μm and is hard, is formed.

In this embodiment, the rolling reduction of the final stand refers to the rolling reduction in the stand in the last stage among the stands in which rolling with a rolling reduction of 5% or more is performed on the steel sheet. That is, a rolled state with a rolling reduction of less than 5%, for example, a case in which a rolling roll and the steel sheet are simply in contact with each other is not included. The rolling reduction in the final stand is preferably 20% or more and 45% or less in order to sufficiently accumulate dislocations in the austenite.

<Primary Cooling Process>

<Intermediate Air Cooling Process>

After the end of the rolling, in order to effectively utilize the dislocations accumulated by the rolling, the primary cooling is started within 1.5 seconds. Time between the end of the rolling (after the rolling in the final stand) and start of the cooling exceeds 1.5 seconds, the dislocations in the austenite are reduced in amount due to recovery and recrystallization. In this case, the target structure cannot be obtained.

During the primary cooling, cooling is performed to 600° C. or higher and 750° C. or lower at a cooling rate of 40° C./s or more. After the completion of the primary cooling, air cooling (intermediate air cooling) with an average cooling rate of 10° C./s or less is performed for two seconds or longer and ten seconds or shorter. The intermediate air cooling may be so-called natural air cooling. During the intermediate air cooling, ferrite is formed, and C enrichment in non-transformed austenite occurs due to the diffusion of C. As the ferrite is formed, the ductility is improved, and the enriched C in the austenite contributes to the strength of martensite formed by subsequent cooling. When the cooling rate of the primary cooling is less than 40° C./s, ferritic transformation occurs during cooling, and the C diffusion rate in the austenite at a high temperature increases. As a result, hard martensite is formed, and the hole expansibility deteriorates. When the primary cooling stop temperature (intermediate air cooling start temperature) exceeds 750° C., the area ratio of the ferrite is insufficient. When the intermediate air cooling start temperature is lower than 600° C., and the cooling rate of the primary cooling exceeds 40° C./s, or the intermediate air cooling time is shorter than two seconds, a predetermined fraction of the ferrite is not obtained, and the fraction of the martensite increases. When the intermediate air cooling time exceeds ten seconds, C is excessively diffused in the austenite, and the hole expansibility deteriorates. In order to suppress C enrichment in the austenite in an appropriate range while securing a target structure fraction, it is desirable to set the air cooling time to eight seconds or shorter.

There is no need to limit the upper limit of the cooling rate of the primary cooling. However, in consideration of constraints of facilities, and in order to make the structural distribution in a sheet thickness direction uniform, the cooling rate is preferably 200° C./s or less.

<Secondary Cooling Process>

<Winding Process>

In order to transform the austenite enriched with C into martensite in the primary cooling process and the intermediate air cooling process, cooling (secondary cooling) is performed to 300° C. or lower at a cooling rate of 60° C./s or more after the intermediate air cooling and winding is performed. When the secondary cooling stop temperature (winding temperature) exceeds 300° C., bainite and pearlite are formed during the winding, and the elongation of the hot rolled steel sheet decreases. When the cooling rate of the secondary cooling is less than 60° C./s, bainite and pearlite are formed during the cooling, and a composite structure primarily consisting of ferrite and martensite is not obtained.

There is no need to limit the upper limit of the cooling rate of the secondary cooling. However, in consideration of constraints of facilities, and in order to make the structural distribution in the sheet thickness direction uniform, the cooling rate is preferably 200° C./s or less.

EXAMPLES

Hereinafter, the high strength hot rolled steel sheet of the present invention will be described in detail with reference to examples. However, conditions in the examples are examples of conditions employed to confirm the feasibility and effects of the present invention, and the present invention is not limited to the following examples. It is possible to carry out the present invention in appropriate modifications thereof within a range that conforms to the gist as long as the object of the present invention can be achieved without departing from the gist of the present invention. Therefore, the present invention can employ various conditions, all of which are included in the technical features of the present invention.

Steel having the chemical composition shown in Table 1 was melted in a converter and was continuously cast into a slab having a thickness of 230 mm. Thereafter, the slab was heated to a temperature of 1200° C. to 1250° C., and was subjected to rough rolling, and finish rolling, primary cooling, intermediate air cooling, secondary cooling, and winding was performed thereon under the conditions shown in Table 2, thereby manufacturing a hot rolled steel sheet. The cooling rate of the intermediate air cooling was 3 to 8° C./s.

Table 2 shows kinds of steel used, finish rolling conditions, and the sheet thicknesses of steel sheets. In Table 2, "latter stage rolling reduction ratio" is the ratio of the total rolling reduction of the final stand and the preceding stand to the sum of the rolling reductions of stands of continuous finish rolling stands, "F5 rolling reduction" is the rolling reduction in the stand in the stage preceding the final stand, "FT5" is the rolling temperature of the stand in the stage preceding the final stand, "F6 rolling reduction" is the rolling reduction of the final stand, "FT6" is the rolling temperature of the final stand, "rolling reduction ratio" is the ratio of the rolling reduction of the final stand to the rolling reduction of the preceding stand, "cooling start" is the time from the end of the finish rolling to the start of the primary cooling, "primary cooling" is the average cooling rate between the end of the finish rolling and the intermediate air cooling start temperature, "air cooling temperature" is the temperature at which the primary cooling is stopped and the intermediate air cooling is started, "air cooling time" is the intermediate air cooling time, "secondary cooling" is the average cooling rate during the secondary cooling until the winding after the intermediate air cooling, and "winding temperature" is the winding temperature after the end of the secondary cooling.

TABLE 1

| Kind of steel | C | Si | Mn | P | S | Al | N | Ti | Nb | Ca | Mo | Cr | Ar3 (° C.) |
|---|---|---|---|---|---|---|---|---|---|---|---|---|---|
| | Composition (mass %) remainder: Fe and impurities | | | | | | | | | | | | |
| A | 0.04 | 1.20 | 1.0 | 0.015 | 0.0030 | 0.12 | 0.004 | 0.11 | — | — | — | — | 845 |
| B | 0.10 | 1.20 | 1.0 | 0.014 | 0.0042 | 0.25 | 0.004 | 0.08 | — | 0.0011 | — | — | 830 |
| C | 0.21 | 0.30 | 1.2 | 0.014 | 0.0030 | 0.25 | 0.003 | 0.12 | — | 0.0008 | 0.35 | — | 746 |
| D | 0.12 | 1.30 | 1.4 | 0.015 | 0.0010 | 0.15 | 0.004 | 0.12 | 0.015 | — | — | — | 786 |
| E | 0.08 | 1.20 | 2.0 | 0.015 | 0.013 | 0.15 | 0.003 | 0.13 | — | — | 0.20 | — | 741 |
| F | 0.15 | 0.80 | 2.0 | 0.014 | 0.0030 | 0.40 | 0.004 | 0.07 | 0.035 | — | — | 0.3 | 715 |
| G | 0.11 | 1.00 | 2.0 | 0.013 | 0.0060 | 0.30 | 0.003 | 0.11 | — | 0.0018 | — | — | 730 |
| H | 0.12 | 1.00 | 0.5 | 0.015 | 0.0050 | 0.05 | 0.004 | 0.11 | — | — | — | — | 855 |
| I | 0.15 | 0.40 | 2.0 | 0.015 | 0.0030 | 0.38 | 0.004 | 0.04 | — | 0.0021 | 0.05 | — | 701 |

TABLE 2

| Test No. | Kind of steel | latter stage rolling reduction ratio — | F5 rolling reduction % | FT5 ° C. | F6 rolling reduction % | FT6 ° C. | Rolling reduction ratio — | Cooling start sec | Primary cooling ° C./sec | Air cooling temperature ° C. | Air cooling time sec | Secondary cooling ° C./sec | Winding temperature ° C. | Sheet thickness mm |
|---|---|---|---|---|---|---|---|---|---|---|---|---|---|---|
| 1 | A | 0.15 | 35 | 869 | 26 | 868 | 0.75 | 0.7 | 0 | 720 | 6 | 109 | 100 | 2.9 |
| 2 | A | 0.18 | 36 | 936 | 13 | 894 | 0.36 | 0.4 | 108 | 674 | 4 | 62 | 250 | 2.9 |
| 3 | A | 0.18 | 36 | 881 | 33 | 868 | 0.92 | 0.4 | 0.20 | 731 | 5 | 111 | 250 | 1.8 |
| 4 | A | 0.22 | 38 | 921 | 20 | 884 | 0.53 | 0.7 | 109 | 615 | 5 | 140 | 250 | 1.8 |
| 5 | A | 0.08 | 50 | 977 | 47 | 962 | 0.93 | 0.7 | 76 | 696 | 8 | 85 | 100 | 2.0 |
| 6 | B | 0.21 | 51 | 954 | 36 | 913 | 0.71 | 0.7 | 80 | 657 | 5 | 114 | 100 | 2.0 |
| 7 | B | 0.15 | 45 | 935 | 28 | 876 | 0.63 | 0.8 | 0 | 673 | 9 | 98 | 100 | 1.6 |
| 8 | B | 0.26 | 48 | 919 | 29 | 870 | 0.60 | 0.6 | 88 | 772 | 5 | 89 | 260 | 1.6 |
| 9 | B | 0.26 | 46 | 952 | 40 | 874 | 0.87 | 0.8 | 97 | 711 | 8 | 80 | 260 | 2.0 |
| 10 | C | 0.14 | 46 | 876 | 36 | 872 | 0.78 | 0.7 | 93 | 736 | 3 | 79 | 100 | 3.2 |
| 11 | C | 0.13 | 44 | 920 | 25 | 892 | 0.57 | 0.3 | 98 | 636 | 3 | 104 | 100 | 2.0 |
| 12 | C | 0.21 | 51 | 933 | 37 | 887 | 0.73 | 1.8 | 92 | 687 | 7 | 122 | 100 | 3.2 |
| 13 | C | 0.24 | 48 | 886 | 30 | 867 | 0.62 | 0.8 | 109 | 702 | 2 | 99 | 100 | 3.2 |
| 14 | C | 0.13 | 48 | 957 | 31 | 869 | 0.65 | 0.5 | 104 | 630 | 6 | 118 | 120 | 2.6 |
| 15 | D | 0.22 | 48 | 890 | 43 | 882 | 0.89 | 0.8 | 61 | 730 | 4 | 131 | 120 | 4.5 |
| 16 | D | 0.14 | 43 | 926 | 33 | 919 | 0.77 | 0.7 | 33 | 642 | 8 | 97 | 120 | 4.5 |
| 17 | D | 0.15 | 37 | 908 | 42 | 883 | 1.14 | 0.6 | 99 | 645 | 6 | 137 | 120 | 4.5 |
| 18 | D | 0.19 | 35 | 874 | 18 | 861 | 0.51 | 0.4 | 78 | 693 | 8 | 84 | 100 | 2.3 |
| 19 | E | 0.24 | 43 | 891 | 39 | 884 | 0.90 | 0.7 | 101 | 735 | 4 | 134 | 100 | 2.3 |
| 20 | E | 0.25 | 34 | 928 | 19 | 907 | 0.57 | 0.4 | 99 | 685 | 15 | 109 | 100 | 2.3 |
| 21 | E | 0.24 | 36 | 871 | 33 | 864 | 0.92 | 0.8 | 77 | 666 | 7 | 125 | 100 | 2.9 |
| 22 | E | 0.19 | 30 | 898 | 24 | 877 | 0.78 | 0.5 | 95 | 530 | 4 | 126 | 100 | 2.9 |
| 23 | F | 0.24 | 34 | 886 | 25 | 869 | 0.73 | 0.5 | 87 | 662 | 9 | 102 | 100 | 2.9 |
| 24 | F | 0.16 | 22 | 903 | 13 | 872 | 0.61 | 0.4 | 82 | 691 | 5 | 107 | 400 | 1.6 |
| 25 | F | 0.17 | 46 | 909 | 39 | 880 | 0.85 | 0.6 | 88 | 662 | 5 | 99 | 100 | 1.6 |
| 26 | F | 0.20 | 48 | 942 | 42 | 904 | 0.88 | 0.8 | 97 | 701 | 8 | 90 | 100 | 1.6 |
| 27 | G | 0.42 | 32 | 886 | 28 | 872 | 0.88 | 0.7 | 93 | 636 | 3 | 89 | 30 | 2.0 |
| 28 | G | 0.16 | 38 | 917 | 27 | 892 | 0.71 | 0.3 | 69 | 627 | 4 | 113 | 30 | 1.8 |
| 29 | G | 0.13 | 30 | 881 | 26 | 877 | 0.88 | 0.7 | 74 | 697 | 7 | 76 | 30 | 1.8 |
| 30 | G | 0.27 | 35 | 937 | 28 | 869 | 0.80 | 0.5 | 68 | 600 | 5 | 125 | 30 | 3.6 |
| 31 | G | 0.17 | 32 | 912 | 25 | 892 | 0.78 | 0.6 | 121 | 630 | 1 | 165 | 100 | 3.6 |
| 32 | G | 0.16 | 45 | 892 | 38 | 873 | 0.84 | 0.7 | 95 | 635 | 9 | 67 | 100 | 2.9 |
| 33 | H | 0.23 | 39 | 894 | 23 | 865 | 0.61 | 0.7 | 103 | 656 | 3 | 84 | 100 | 3.6 |
| 34 | I | 0.17 | 34 | 949 | 19 | 938 | 0.57 | 0.6 | 77 | 612 | 6 | 62 | 100 | 3.6 |

Regarding the steel sheet obtained as described above, visual fields are randomly selected at a thickness ¼ position of the steel sheet, the structure fractions of ferrite and martensite and the hardness ratio between the martensite and the ferrite were examined in at least five visual fields using an optical microscope.

Regarding the structure fractions and grain sizes of the ferrite and the martensite of the steel sheet, five visual fields of 500 μm×500 μm were randomly photographed using the optical microscope after Nital etching, and the average area ratio and the average grain size of the five visual fields were obtained using image analysis.

Regarding the hardnesses of the martensite and the ferrite, a micro Vickers test was conducted on each structure, the Vickers hardnesses (Hv) of 100 or more points in each of the structures of the martensite and the ferrite were measured, and the average thereof was obtained.

Regarding a tensile test of the steel sheet, a JIS No. 5 test piece was taken in the rolling width direction (C direction) of the steel sheet, and according to JIS Z 2241, yield strength: YP (MPa), tensile strength: TS (MPa), and elongation: EL (%) were evaluated.

Hole expansibility λ (%) was evaluated according to the method defined in JIS Z 2256.

Table 3 shows the evaluation results of the obtained structure and material. In Table 3, "area ratio of each structure" is the area ratio of each of the ferrite, martensite, and other structures, "M diameter" is the average grain size of the martensite, and "hardness ratio" is the hardness ratio obtained by (hardness of martensite/hardness of ferrite).

TABLE 3

| Test | Area ratio of each structure (%) | | | Proportion of martensite having grain size of 10 to 30 μm | M diameter | Hardness ratio | Yield strength | Tensile strength | Elongation | Hole expansibility | |
|---|---|---|---|---|---|---|---|---|---|---|---|
| No. | Ferrite | Martensite | Others | % | μm | — | MPa | MPa | % | % | Note |
| 1 | 55 | 45 | 0 | 42 | 13.3 | 1.0 | 827 | 1028 | 18 | 70 | Example of Present Invention |
| 2 | 36 | 64 | 0 | 15 | 62.5 | 0.4 | 843 | 1016 | 9 | 61 | Comparative Example |
| 3 | 53 | 47 | 0 | 44 | 30.1 | 0.6 | 810 | 997 | 19 | 64 | Example of Present Invention |
| 4 | 52 | 48 | 0 | 53 | 24.3 | 0.7 | 870 | 1015 | 19 | 71 | Example of Present Invention |
| 5 | 21 | 79 | 0 | 53 | 27.6 | 0.7 | 1053 | 1212 | 8 | 34 | Comparative Example |
| 6 | 54 | 46 | 0 | 44 | 18.6 | 0.8 | 854 | 1024 | 18 | 73 | Example of Present Invention |
| 7 | 50 | 50 | 0 | 52 | 25.1 | 0.7 | 821 | 997 | 18 | 83 | Example of Present Invention |
| 8 | 18 | 82 | 0 | 54 | 39.5 | 0.3 | 899 | 1025 | 8 | 43 | Comparative Example |
| 9 | 65 | 35 | 0 | 48 | 21.2 | 0.8 | 802 | 1001 | 18 | 79 | Example of Present Invention |
| 10 | 63 | 37 | 0 | 47 | 19.6 | 0.8 | 911 | 1028 | 18 | 74 | Example of Present Invention |
| 11 | 59 | 41 | 0 | 49 | 29.8 | 0.6 | 816 | 1015 | 19 | 70 | Example of Present Invention |
| 12 | 61 | 39 | 0 | 18 | 51.4 | 0.3 | 874 | 1023 | 9 | 41 | Comparative Example |
| 13 | 59 | 41 | 0 | 48 | 20.2 | 0.8 | 858 | 1000 | 18 | 80 | Example of Present Invention |
| 14 | 61 | 39 | 0 | 46 | 16.7 | 0.9 | 852 | 995 | 19 | 74 | Example of Present Invention |
| 15 | 59 | 41 | 0 | 40 | 31.9 | 0.6 | 848 | 987 | 19 | 76 | Example of Present Invention |
| 16 | 49 | 43 | 8 | 49 | 19.5 | 2.2 | 903 | 1030 | 17 | 32 | Comparative Example |
| 17 | 81 | 19 | 0 | 37 | 3.7 | 3.5 | 827 | 1009 | 19 | 39 | Comparative Example |
| 18 | 48 | 52 | 0 | 58 | 10.5 | 0.9 | 849 | 992 | 19 | 69 | Example of Present Invention |
| 19 | 50 | 50 | 0 | 47 | 13.6 | 0.9 | 860 | 1011 | 18 | 67 | Example of Present Invention |
| 20 | 49 | 12 | 39 | 31 | 13.1 | 1.2 | 838 | 984 | 8 | 82 | Comparative Example |
| 21 | 61 | 39 | 0 | 39 | 29.1 | 0.7 | 854 | 1012 | 19 | 69 | Example of Present Invention |
| 22 | 33 | 60 | 7 | 56 | 11.9 | 1.2 | 882 | 981 | 9 | 79 | Comparative Example |
| 23 | 62 | 38 | 0 | 50 | 12.3 | 1.1 | 855 | 995 | 19 | 75 | Example of Present Invention |
| 24 | 22 | 43 | 35 | 43 | 13.3 | 0.9 | 892 | 985 | 7 | 65 | Comparative Example |
| 25 | 58 | 42 | 0 | 44 | 10.7 | 1.2 | 999 | 1023 | 18 | 80 | Example of Present Invention |
| 26 | 45 | 55 | 0 | 50 | 20.0 | 0.9 | 902 | 1010 | 17 | 79 | Example of Present Invention |
| 27 | 53 | 47 | 0 | 3 | 59.2 | 0.2 | 921 | 1038 | 8 | 74 | Comparative Example |
| 28 | 75 | 25 | 0 | 34 | 19.0 | 0.9 | 895 | 1003 | 19 | 72 | Example of Present Invention |
| 29 | 54 | 46 | 0 | 49 | 15.5 | 0.8 | 831 | 1002 | 18 | 87 | Example of Present Invention |
| 30 | 63 | 37 | 0 | 40 | 19.1 | 0.7 | 827 | 998 | 19 | 79 | Example of Present Invention |
| 31 | 25 | 75 | 0 | 69 | 31.2 | 0.3 | 923 | 1185 | 8 | 42 | Comparative Example |
| 32 | 55 | 45 | 0 | 45 | 15.6 | 1.0 | 825 | 998 | 18 | 77 | Example of Present Invention |
| 33 | 35 | 42 | 23 | 43 | 14.0 | 0.8 | 831 | 984 | 7 | 83 | Comparative Example |
| 34 | 47 | 53 | 0 | 48 | 10.5 | 1.0 | 783 | 853 | 19 | 70 | Comparative Example |

As shown in Table 3, in the examples of the present invention, the tensile strength was 980 MPa or more, the structure fraction of the ferrite was 40% or more, the structure fraction of the martensite was 20% or more and 60% or less, and the hardness ratio of the martensite to the ferrite was 0.6 or more and 1.6 or less. Furthermore, as a result, in the examples of the present invention, the elongation was 10% or more, the hole expansibility was 50% or more, and thus the balance between the elongation and the hole expansibility was excellent.

Contrary to this, in Test No. 2, a target structure fraction (area ratio of each structure) was not obtained. It is considered that this was caused by a low ratio (F6/F5) between the rolling reductions of F5 and F6 and delayed ferritic transformation. In addition, in Test No. 2, the grain size of the austenite was coarsened, the average grain size of the martensite grains was coarsened, the martensite was softened, and the hardness ratio decreased. As a result, the elongation was inferior.

In Test No. 5, a target structure fraction was not obtained, and the elongation and the hole expansibility were inferior. It is considered that this was because the latter stage rolling reduction ratio was low, the finish rolling temperature was high, and the ferritic transformation was delayed.

In Test No. 8, a target structure fraction was not obtained, and the elongation and the hole expansibility were inferior. It is considered that this was because the air cooling temperature was high and the ferritic transformation during the air cooling was delayed.

In Test No. 12, the average grain size was the martensite grains was coarsened, the hardness ratio was less than 0.6, and thus the elongation and the hole expansibility were inferior. It is considered that this was because the cooling start time after the rolling was long and the austenite grains were coarsened.

In Test No. 16, the hardness ratio was more than 1.6, and the hole expansibility was inferior. It is considered that this was because the primary cooling was slow, C enrichment in the austenite had proceeded, and thus the martensite was hardened.

In Test No. 17, the hardness ratio was more than 1.6, and the hole expansibility was inferior. It is considered that this was because since the ratio of F6 to the rolling reductions of F5 was 1.0 or more, ferritic transformation had excessively proceeded, C enrichment was promoted, and thus the martensite was excessively hardened.

In Test No. 20, the area ratio was the martensite was low, and the elongation was inferior. It is considered that this was because the air cooling time was 15 seconds, and bainitic transformation had proceeded during the air cooling.

In Test No. 22, the area ratio was the ferrite was low, and the elongation was inferior. It is considered that this was because the air cooling temperature was low and the ferritic transformation had not sufficiently proceeded.

In Test No. 24, a target structure was not obtained, and the elongation and the hole expansibility were inferior. It is considered that this was because the winding temperature was high.

In Test No. 27, coarse martensite was formed, the hardness ratio between the structures was low, and the elongation was inferior. It is considered that this was because the rolling reduction in the latter stage was high, rolling in the former stage was insufficiently performed, and thus the austenitic structure was coarsened.

In Test No. 31, a target structure was not obtained, and the elongation and the hole expansibility were inferior. It is considered that this was because the air cooling time was short.

In Test No. 33, since the Al content was insufficient, a target area ratio of the ferrite was not obtained, and the elongation was inferior.

In Test No. 34, since the Ti content was insufficient, the amount of precipitation strengthening caused by Ti was insufficient, and a tensile strength of 980 MPa was not obtained.

INDUSTRIAL APPLICABILITY

According to the present invention, a high strength hot rolled steel sheet which is suitable for press components requiring high workability and is excellent in elongation and hole expansibility can be provided. With the high strength steel sheet, a reduction in the weight of the vehicle body of a vehicle or the like, integral forming of components, and a reduction in the number of working processes are possible, and the improvement of fuel efficiency and a reduction in manufacturing costs can be achieved. Therefore, the present invention has a high industrial value.

What is claimed is:

1. A high strength hot rolled steel sheet comprising, by mass %:

C: 0.02% or more and 0.30% or less;
Si: 0.20% or more and 2.0% or less;
Mn: 0.5% or more and 3.0% or less;
P: 0.10% or less;
S: 0.010% or less;
Al: 0.10% or more and 1.0% or less;
N: 0.010% or less;
Ti: 0.06% or more and 0.20% or less;
Nb: 0% or more and 0.10% or less;
Ca: 0% or more and 0.0060% or less;
Mo: 0% or more and 0.50% or less;
Cr: 0% or more and 1.0% or less; and
a remainder of Fe and impurities, wherein a structure of the high strength hot rolled steel sheet contains a martensite in an area ratio of 20% or more and 60% or less and a ferrite in an area ratio of 40% or more, and a total area ratio of the martensite and the ferrite is 90% or more, an average grain size of the martensite is 5.0 μm or more and 50 μm or less, a ratio of a hardness of the martensite to a hardness of the ferrite is 0.6 or more and 1.6 or less, and a tensile strength of the high strength hot rolled steel sheet is 980 MPa or more.

2. The hot rolled steel sheet according to claim 1, wherein the hot rolled steel sheet comprises one or more of, by mass %:

Nb: 0.01% or more and 0.10% or less;
Ca: 0.0005% or more and 0.0060% or less;
Mo: 0.02% or more and 0.50% or less; and
Cr: 0.02% or more and 1.0% or less.

* * * * *